US005778694A

United States Patent [19]

Jeong

[11] Patent Number: 5,778,694

[45] Date of Patent: Jul. 14, 1998

[54] COOLING AIR SUPPLY CONTROL APPARATUS OF REFRIGERATOR

[75] Inventor: Seong-Wook Jeong, Suwon, Rep. of Korea

[73] Assignee: Samsung Electronics Co., Ltd., Suwon, Rep. of Korea

[21] Appl. No.: 583,052

[22] PCT Filed: Apr. 3, 1995

[86] PCT No.: PCT/KR95/00031

§ 371 Date: Jan. 19, 1996

§ 102(e) Date: Jan. 19, 1996

[87] PCT Pub. No.: WO95/27238

PCT Pub. Date: Oct. 12, 1995

[30] Foreign Application Priority Data

Apr. 4, 1994 [KR] Rep. of Korea ..... 1994-7078

[51] Int. Cl.[6] ..... F25D 17/04

[52] U.S. Cl. ..... 62/187; 62/408; 236/51

[58] Field of Search ..... 62/186, 187, 407, 62/408, 444, 447; 236/49.3, 51

[56] References Cited

U.S. PATENT DOCUMENTS

| | | | |
|---|---|---|---|
| 4,527,734 | 7/1985 | Swain et al. | 62/187 X |
| 4,635,445 | 1/1987 | Otsuka et al. . | |
| 4,704,874 | 11/1987 | Thompson et al. | 62/187 |
| 4,788,827 | 12/1988 | Otani . | |
| 5,172,566 | 12/1992 | Jung et al. | 62/186 |
| 5,201,888 | 4/1993 | Beach, Jr. et al. | 62/187 |
| 5,224,355 | 7/1993 | So et al. . | |
| 5,331,825 | 7/1994 | Kim | 236/51 X |
| 5,344,069 | 9/1994 | Narikiyo . | |

FOREIGN PATENT DOCUMENTS

| | | | |
|---|---|---|---|
| 63-10392 | 1/1988 | Japan . | |
| 5-93571 | 4/1993 | Japan | 62/187 |
| 2201014 | 8/1988 | United Kingdom | 62/187 |
| WO94/16273 | 7/1994 | WIPO . | |

*Primary Examiner*—Henry A. Bennett
*Assistant Examiner*—Susanne C. Tinker
*Attorney, Agent, or Firm*—Burns, Doane, Swecker & Mathis, L.L.P.

[57] ABSTRACT

A refrigerator includes a plurality of cold air inlet openings formed in a rear wall of the refrigerating compartment for directing cold air in respective directions into the refrigerating compartment. A motor-driven rotary damper is provided to control which of the inlet openings receives cold air, as well as the quantity of air introduced into the refrigerating chamber, and its direction of introduction. The cold air is supplied by a variable speed fan controlled so that in a first mode (cubic cooling) of cooling operation the amount of air supplied corresponds to the number of air inlet openings opened by the damper. In a second cooling mode (concentrated cooling), the damper is oriented to cause the air to be introduced into the refrigerating chamber in a specific direction where cooling is needed. In a third cooling mode (automatic swinging), the damper is oscillated while the cold air is being supplied.

10 Claims, 13 Drawing Sheets

COOLING AIR SUPPLY CONTROL APPARATUS OF REFRIGERATOR

FIELD OF THE INVENTION

The present invention relates to a cooling air supply control apparatus of a refrigerator and a control method thereof, which can adjust the amount and discharge direction of cooling air in order to stably maintain a desired temperature in the refrigerator regardless of opening and/or closing of a door thereof and the existence of high temperature food in the refrigerator.

BACKGROUND OF THE INVENTION

Generally, the temperature in a conventional refrigerator is detected by a temperature sensor disposed at a predetermined position therein, and if the detected temperature in the refrigerator is above a reference temperature pre-established in a microcomputer, a compressor therein is driven, and at the same time, a damper is opened, thereby causing the cooling air to be discharged through a plurality of discharge ports arranged in a refrigerating chamber, freezing chamber, vegetable chamber or the like, so that the temperature therein can be lowered.

Meanwhile, if the temperature detected by the temperature sensor is lower than the reference temperature, driving of the compressor is caused to stop, and at the same time, the damper is closed, thereby preventing the temperature in the refrigerating chamber, freezing chamber, vegetable chamber or the like from being excessively lowered.

As a prior art, Japanese laid open utility model No. Sho 63-10392 published on Aug. 13, 1990, discloses a cooling air circulation apparatus, where the cooling air is discharged at a stretch toward top sides of the respective chambers from air holes formed at a front side of a blowing apparatus.

Part of the cooling air discharged through the air holes is conducted down to a front area of a door from a top area of the door, and the same time, is conducted into the refrigerating chamber or vegetable chamber through air holes provided in front of the refrigerating chamber and vegetable chamber.

Furthermore, part of the cooling air is conducted down through a gap formed between a food shelf and a lower side of the inner door, and part of the cooling air is discharged toward an inner upper area of the chamber and conducted down through a gap formed between frost formed behind the food shelf.

An opening for re-circulating the cooling air whose temperature has been increased by absorbing heat from the food stored in the chamber is formed at a rear portion of a floor unit in the refrigerating chamber.

However, in the conventional refrigerator thus constructed, there is a problem in that because a predetermined amount of the cooling air is discharged in a predetermined direction regardless of temperature changes in the refrigerating chamber, freezing chamber or in the vegetable chamber, the temperature in the chambers cannot be maintained at a constant level, thereby causing a degradation of the degree of freshness of the food disposed at an area where the cooling air is not smoothly circulated, and at the same time, lots of time is consumed in order to maintain at a predetermined level an overall temperature in the chambers when hot food is placed thereinto, thereby causing an increase of electric power consumption.

SUMMARY OF THE INVENTION

Accordingly, the present invention is disclosed to solve the aforementioned problems, and it is an object of the present invention to provide a cooling air supply control apparatus of a refrigerator and a control method thereof by which an eccentric damper for adjusting a discharge amount and discharge direction of the cooling air is controllably driven to thereby cause the cooling air to be partially discharged or discharged to the left or right side or maintenance of the temperature in the chambers at a predetermined constant level, and at the same time, the overall temperatures in all the chambers are maintained constant within a shortest possible time by concentratively cooling an area where the hot food is placed even though the hot food is put into the chambers, to thereby reduce the power consumption and temperature variation rate in the chambers.

It is another object of the present invention to provide a cooling air supply control apparatus of a refrigerator and a control method thereof by which an eccentric damper is controllably driven by a stepping motor for being driven by a control of control means, to not only cool a particular area concentratively but also to cool overall inner areas of the chambers within a shortest possible time and to thereby maintain overall inner temperatures of the chambers at predetermined constant levels.

In accordance with one aspect of the present invention, there is provided a cooling air supply control apparatus of a refrigerator, the apparatus comprising:

key operation means for operating keys so that a user can select a desired operation mode;

temperature detecting means for detecting temperatures in the refrigerating chamber;

control means for controlling a cooling operation of the refrigerator according to temperature difference in the chamber detected by an operation mode selected by the key operation means and the temperature detecting means;

stepping motor driving means for driving a stepping motor so that an eccentric damper can be rotated according to the control of the control means;

a reed switch for detecting a position of the eccentric damper in the course of driving of the stepping motor according to an output signal of the stepping motor driving means to thereby output the same to the control means; and fan motor driving means for driving a fan motor in order to maintain the temperature in the chamber at a predetermined constant level according to the control of the control means.

In accordance with another aspect of the present invention, there is provided a cooling air supply control method of a refrigerator, the method comprising the steps of:

discriminating a present position of the eccentric damper;

driving the fan motor to quickly cool the refrigerating chamber according to the present position of the eccentric damper when a cooling mode in the refrigerating chamber is selected as integrated cubic cooling by the operation of the key operation means;

cooling concentratively a particular area of comparatively higher temperature in the refrigerating chamber according to a temperature difference in the refrigerating chamber when the mode in the refrigerating chamber is selected as concentrated cooling by the operation of the key operation means; and reciprocating swingingly the eccentric damper to the left and to the right according to the control of the control means to thereby maintain the temperature in the refrigerating chamber at a predetermined constant level when the cooling mode in the refrigerating chamber is selected as automatic swing by the operation of the key operation means.

According to the cooling air supply control apparatus of a refrigerator and a method thereof thus described, the cooling air discharge quantity and discharge direction are controlled by the stepping motor drive according to adjustment of the control of the eccentric damper, to thereby enable the cooling air to be discharged partially or discharged to the left and to the right in a swing style, so that the temperature in the chamber can be maintained at a predetermined constant level, and a concentrated cooling of a particular area where hot food is placed can decrease time necessary for maintaining the temperature in the refrigerating chamber at a predetermined constant level, to thereby reduce consumption of electric power.

Furthermore, according to the present invention the eccentric damper is controlled by the control means to thereby carry out a concentrated cooling on a particular area, and at the same time, to rapidly cool whole areas within the chambers and to maintain the temperatures in the chambers at a predetermined constant level.

In the above description, the eccentric damper represents a damper which is eccentrically disposed at a rotating shaft of the stepping motor to thereby close or open a cooling air discharge outlet for control of discharge quantity and discharge direction of the cooling air.

BRIEF DESCRIPTION OF THE DRAWINGS

For a better understanding of the nature and objects of the invention, reference should be made to the following detailed description taken in conjunction with the accompanying drawings in which.

DETAILED DESCRIPTION OF A PREFERRED EMBODIMENT OF THE INVENTION

The embodiment of the present invention will now be described in detail with reference to the accompanying drawings.

Figure 1:
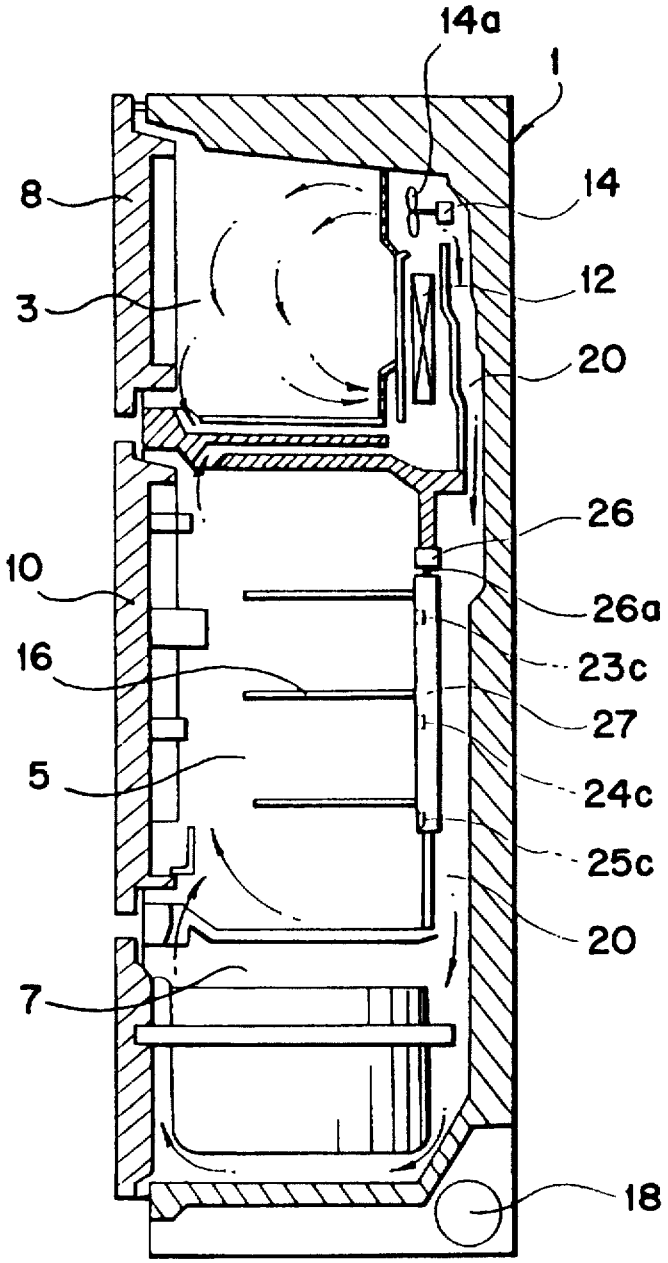
FIG. 1 is a side sectional view of a refrigerator according to one embodiment of the present invention.
Figure 2:
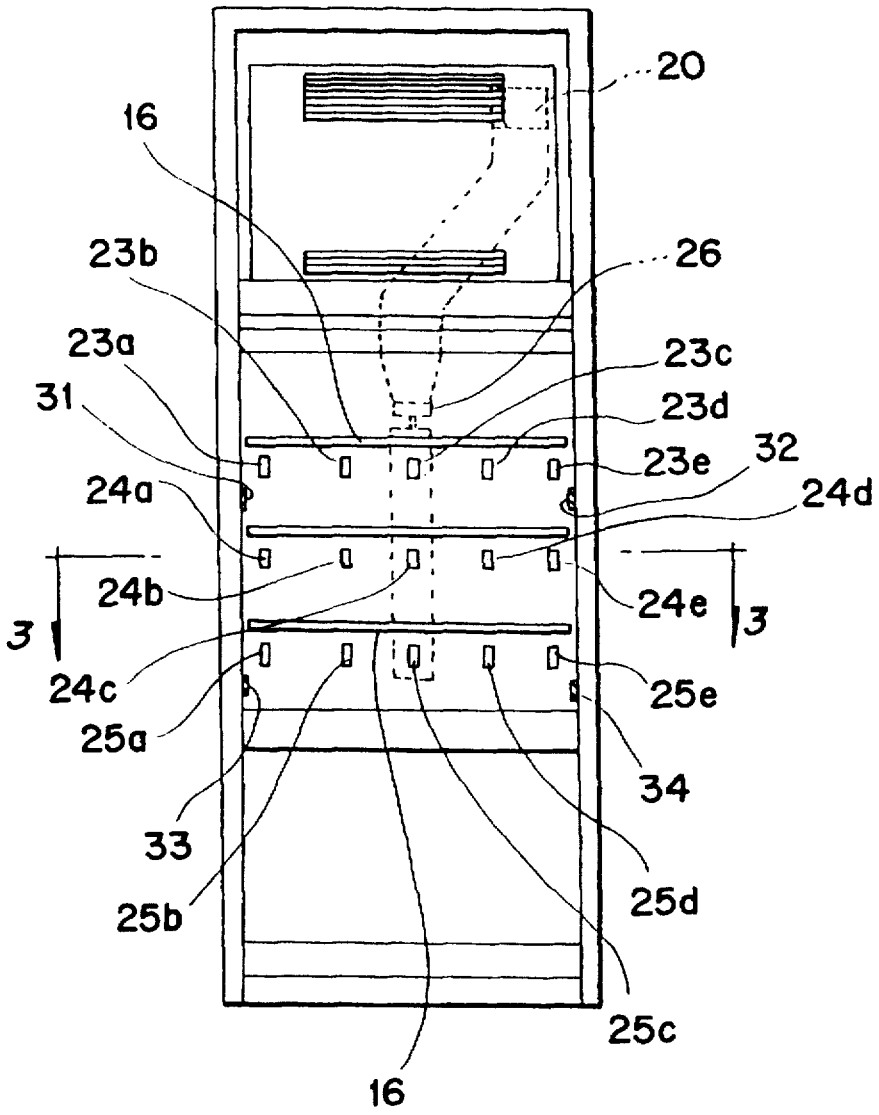
FIG. 2 is a front view of the refrigerator of FIG. 1 with the door removed.
Figure 3:
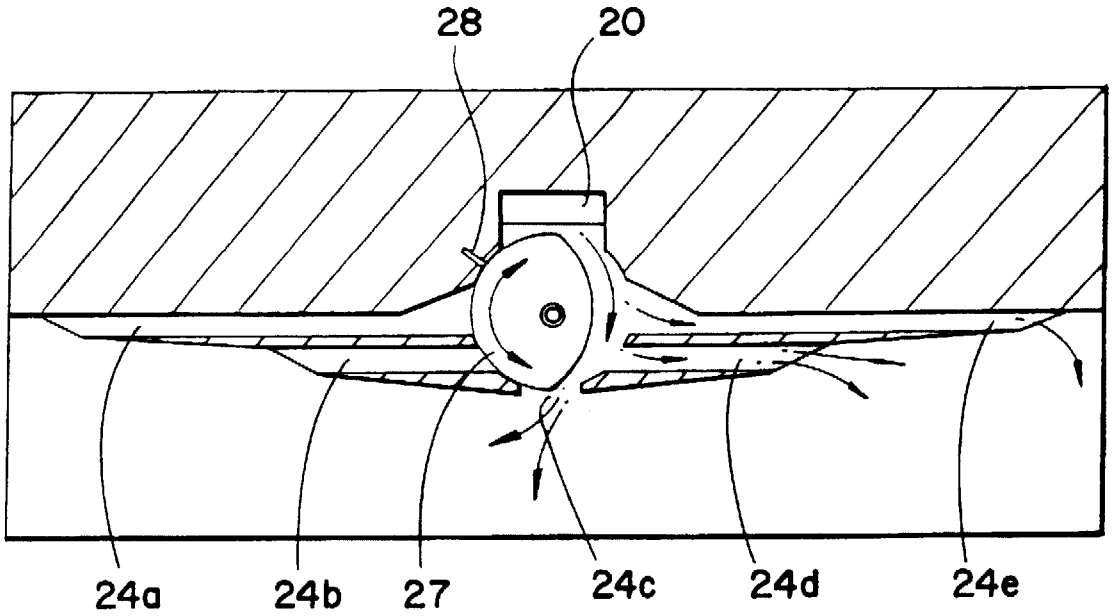
FIG. 3 is a sectional view taken along line 3—3 in FIG. 2.

As illustrated in FIGS. 1, 2 and 3, a freezing chamber 3 a refrigerating chamber 5 and a vegetable chamber 7 for storing food are enclosed within a body 1 of the refrigerator.

The body 1 provided with respective doors 8 and 10 for the freezing chamber 3 and the refrigerating chamber 5.

The freezing chamber 3 is provided at a rear surface thereof with an evaporator 12 for heat-exchanging the hot air in the chambers so that cooling air can be supplied into the freezing chamber 3, refrigerating chamber 5 and the vegetable chamber.

A rotating shaft of a fan motor 14 has a fan 14*a* for circulating the cooling air which has been cooled by the evaporator 12 into the freezing chamber 3, refrigerating chamber 5 and the vegetable chamber 7.

The refrigerating chamber 5 is divided into a plurality of inner spaces by a plurality of shelves so that the food can be placed thereon.

Furthermore, the body 1 is provided with a compressor 18 for compressing refrigerant of low temperature and low pressure resulting from an evaporating operation of the evaporator 12. The freezing chamber 3 and the refrigerating chamber 5 are formed at rear areas thereof with a duct 20 for guiding and supplying the cooling air generated by the evaporator 12 into the freezing chamber 3 and the refrigerating chamber 5 by way of the fan 14*a*.

The refrigerating chamber 5 is formed at a rear wall surface thereof with cooling air discharge outlets (23*a* –23*e*), (24*a*–24*e*) and (25*a*–25*e*) for discharging into the refrigerating chamber 5 the cooling air for flowing through the duct 20. The cooling air discharge outlets 23*c*, 24*c* and 25*c* are provided with an eccentric rotary damper 27 for adjusting the discharge quantity and the discharge direction of the cooling air discharged into the refrigerating chamber 5 through the cooling air discharge outlets (23*a*–23*e*), (24*a*–24*e*) and (25*a*–25*e*).

The eccentric damper 27 opens and/or closes the cooling air discharge outlets (23*a*–23*e*), (24*a*–24*e*) and (25*a*–25*e*) according to control of control means 42.

The eccentric damper 27 is mounted to a rotating shaft 26*a* of a stepping motor 26 in order to close and/or open the cooling air discharge outlets (23*a*–23*e*), (24*a*–24*e*) and (25*a*–25*e*) according to the control of the control means 42.

A reed switch 28 detects a position of the eccentric damper 27 as illustrated in FIG. 3.

The refrigerating chamber 5 is provided therein with temperature detecting means comprising a plurality of thermistors 31, 32, 33 and 34 in order to detect temperatures in respective parts, namely, temperatures in upper left and upper right parts and temperatures in lower left and lower right parts.

Figure 4:
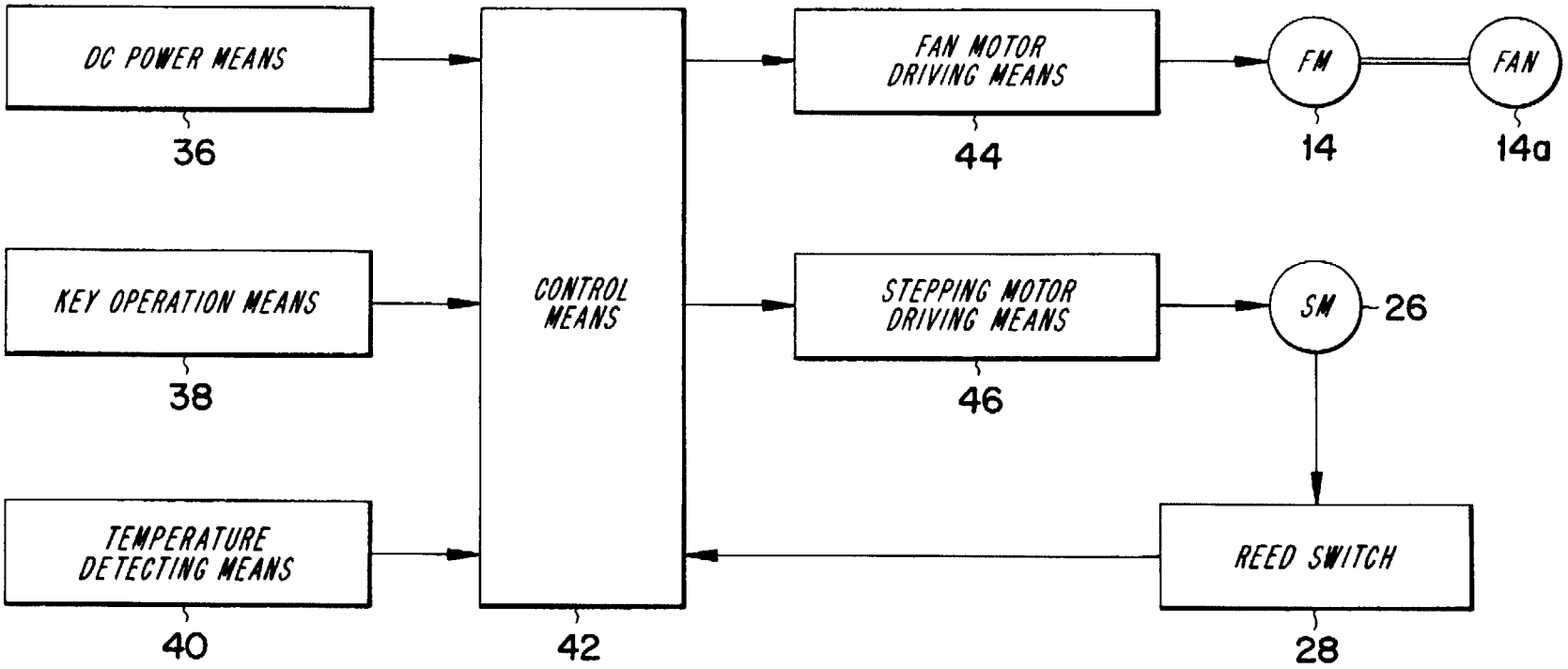
FIG. 4 is a control block diagram of a cooling air supply control apparatus of the refrigerator according to the embodiment of the present invention.

The refrigerator thus constructed, as illustrated in FIG. 4, includes a direct current power means 36 which converts a commercial alternating current (AC) to a direct current (DC) necessary for driving the refrigerator and thereafter output the same.

Key operating means 20 selects operation modes (cubic cooling, concentrated cooling, automatic swing operation and the like) desired by a user.

The temperature detecting means 40 including the thermistors 31, 32, 33 and 34 detects the temperatures in the upper left, upper right, lower left and lower right sides in the refrigerator 5 to thereafter output the same to control means 42.

In the aforesaid description, the control means 42 denotes a microcomputer which receives the DC current supplied from the DC power means 36 to thereby initialize the refrigerator, and at the same time, control an overall cooling operation of the refrigerator according to a temperature difference ΔT in the chamber detected by the temperature detecting means 40 and by the operation mode selected by the key operation means 38.

Furthermore, fan motor driving means 44 receives a control signal from the control means 42 to drive the fan motor 14 to rotate the fan 14*a* so that the cooling air which has been cooled by being heat-exchanged at the evaporator 12 can be circulated.

Stepping motor driving means 46 receives the control signal of the control means according to the temperature difference ΔT in the chamber detected by the temperature detecting means 40 and by the operation mode selected by the key operation means 38, to thereby controllably drive the stepping motor 26 for rotating the eccentric damper 27 so that the cooling air discharge outlets (23*a*–23*e*), (24*a*–24*e*) and (25*a*–25*e*) can be closed and opened.

The read switch 28 is for detecting a position of the eccentric damper 27.

An on/off signal of the reed switch is received at the control means 42 to thereby discriminate the position of the eccentric damper 27.

Now, a cooling air supply control method of the refrigerator thus constructed will be described.

First of all, a control sequence of the refrigerator for changing according to the operation mode selected by the key operation means 38 will be described with reference to FIG. 5.

Figure 5A:
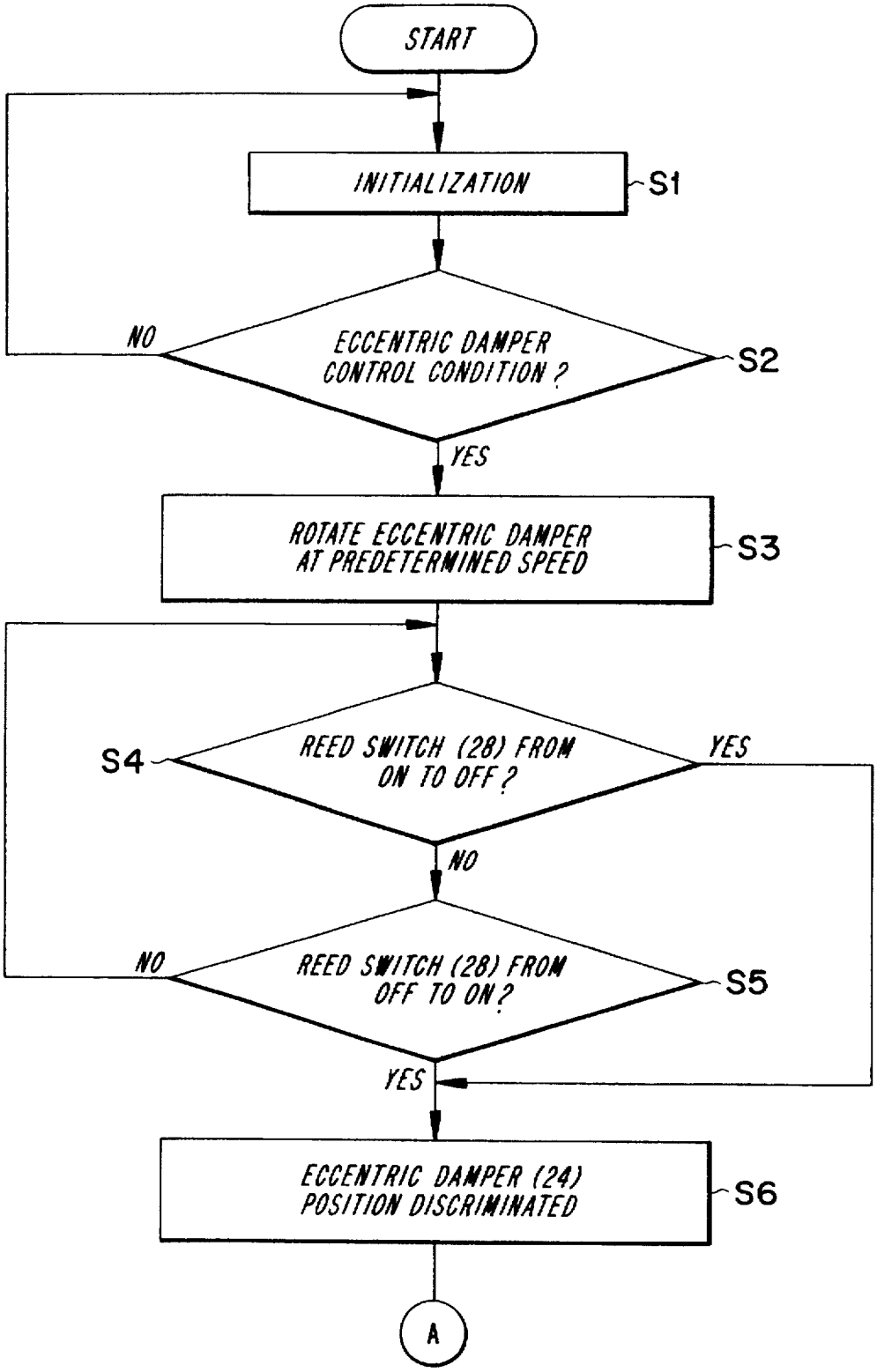
FIGS. 5A and 5B are a flow chart for illustrating an operational sequence of a cooling air supply control in the refrigerator according to the embodiment of the present invention.
Figure 5B:
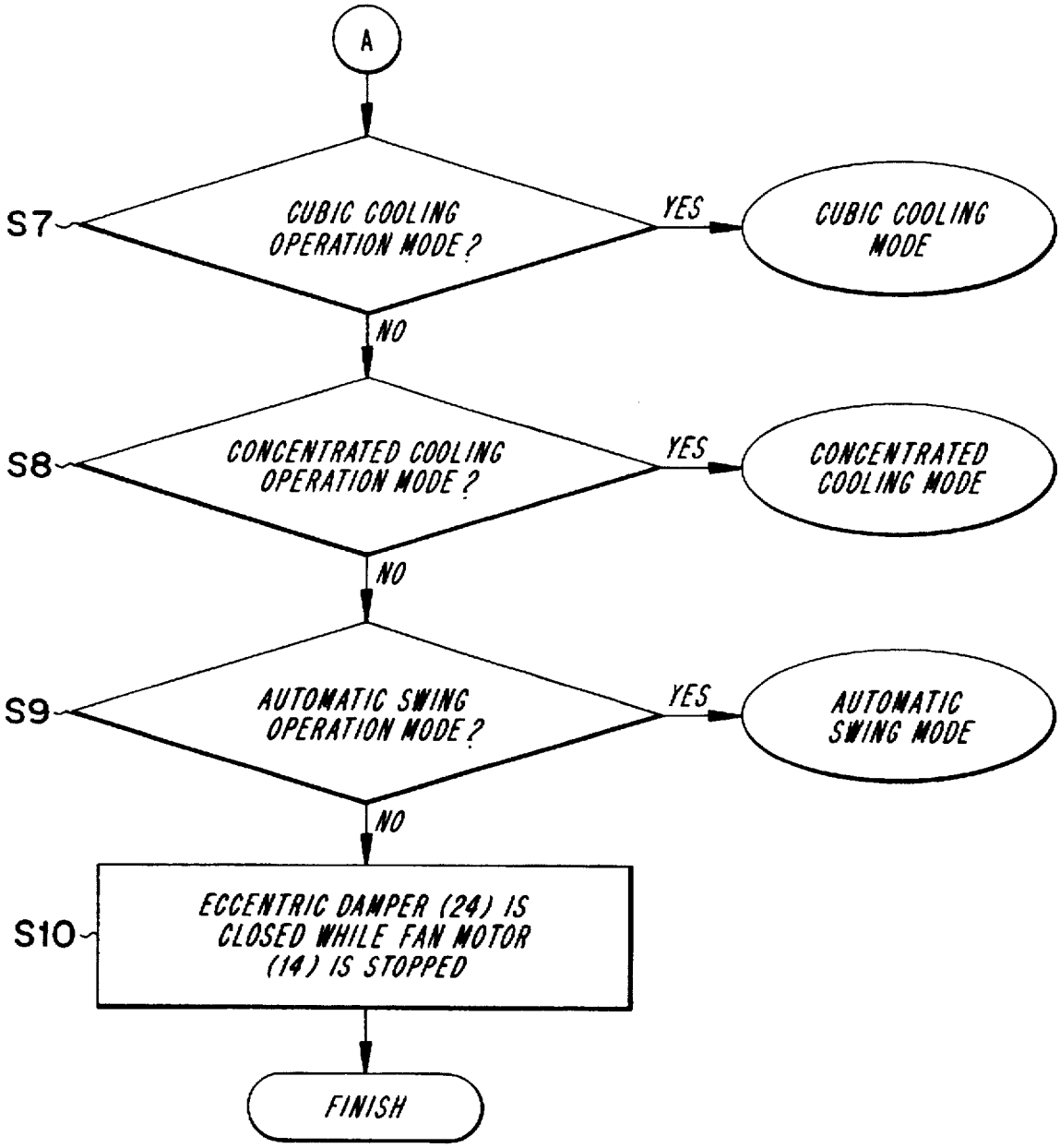

FIG. 5 is a flow chart for illustrating operational procedures of a cooling air supply control in the refrigerator employing the eccentric damper 27 according to the present invention.

Reference symbol S in FIG. 5 represents a method step.

First of all, when the user applies the electric power to the refrigerator, the DC Power means 36 receives the commercial AC power supplied from the AC power input terminal (not shown) and converts the same to a DC current necessary for driving of the refrigerator and outputs the same to respective driving means and control means 42.

Accordingly, at step S1, the control means 42 receives the DC current supplied from the DC power means 36 to thereby initialize the refrigerator according to a cooling air supply control function. The flow now proceeds to step S2, to thereby discriminate whether a condition in the chamber requires changing the eccentric damper 27.

As a result of the discrimination at step S2, if the condition does not require changing the damper 27 (in case of No), the flow returns back to step S1 and repeats operations subsequent to step S1.

As a result of the discrimination at step S2, if the condition requires changing the eccentric damper 27 (in case of Yes), the flow advances to step S3 to ascertain a present position of the eccentric damper 27 and causes the control means 42 to output the control signal to the stepping motor driving means 46.

Accordingly, the stepping motor driving means 46 drives the stepping motor 26 according to the control of the control means 42 to rotate the eccentric damper 27 in a predetermined direction at a predetermined speed.

The flow now proceeds to step S4, and discriminates whether or not the reed switch 28 has changed from On to OFF during rotation of the eccentric damper 27.

As a result of the discrimination at step S4, if the reed switch 28 has not changed from ON to OFF (in case of No), the flow proceeds to step S5, and discriminates whether or not the reed switch 28 has changed from OFF to On during the rotation of the eccentric damper 27.

As a result of the discrimination at step S5, if the reed switch 28 has not changed from ON to OFF (in case of No), the flow returns back to step S4, and repeats an operation of discriminating whether or not the reed switch 28 has changed from ON to OFF.

Meanwhile, as a result of the discrimination at step S4, if the reed switch 28 has changed from ON to OFF (in case of Yes), and as a result of the discrimination at step S5, if the reed switch 28 has changed from OFF to ON (in case of Yes), the flow advances to step S6, to thereby cause the control means 42 to receive a signal coming from the reed switch and to discriminate the position of the eccentric damper 27.

The flow now proceeds to step S7, and discriminates whether or not the operation mode selected by the key operation means 38 is a cubic cooling operation mode, and if the operation mode is the cubic cooling operation mode (in case of Yes), the control means 42 outputs to the fan motor driving means 44 a control signal for driving the fan motor 14 to thereby drive the fan 14*a*, and at the same time, outputs to the stepping motor driving means 46 a control signal for driving the stepping motor 26.

The eccentric damper 27 is then driven to thereby control the refrigerator by way of the cubic cooling operation mode which will be later described.

As a result of the discrimination at step S7, if the operation mode is not the cubic cooling operation mode (in case of No), the flow advances to step S8, and discriminates whether or not the operation mode selected by the key operation mode 38 is a concentrated cooling operation mode. If the operation mode is the concentrated cooling operation mode (in case of Yes), the control means 42 outputs to the fan motor driving means 44 a control signal for driving the fan motor 14 to thereby drive the fan 14*a*, and at the same time, outputs to the stepping motor driving means 44 a control signal for driving the stepping motor 26.

The eccentric damper 27 is then driven to thereby control the refrigerator by way of the concentrated cooling operation mode which will be later described.

Meanwhile, as a result of the discrimination at step S8, if the operation mode is not the concentrated cooling operation mode (in case of No), the flow advances to step S9, and discriminates whether or not the operation mode selected by the key operation mode 38 is an automatic swing operation mode. If the operation mode is the automatic swing operation mode (in case of Yes), the control means 42 outputs to the fan motor driving means 44 a control signal for driving the fan motor 14 to thereby drive the fan 14*a*, and at the same time, the stepping motor driving means 46 outputs a control signal for driving the stepping motor 26. The eccentric damper 27 is then driven to thereby control the refrigerator by way of the automatic swing operation mode which will be later described.

As a result of the discrimination at step S9, if the operation mode is not the automatic swing operation mode (in case of No), the flow advances to step S10, and because a control signal has not been output from the control means 42 to the fan motor driving means 44, the fan motor 14 is stopped.

At this time, because a signal for driving the stepping motor 26 is being input to the stepping motor driving means 46 from the control means 42, the eccentric damper 27 is rotated according to drive of the stopping motor 26, to close a cooling air route of the duct 20 and to thereby terminate control operation of tire refrigerator.

Next, a cooling air supply control operation (cubic cooling operation mode, concentrated operation mode, automatic swing operation mode) of a refrigerator performed in accordance with each operation mode selected by the key operation means 38 will be described in detail.

Cubic Cooling Mode

First of all, a detailed description will be made with reference to FIG. 6 about a case where the cubic cooling operation mode is selected by the key operation means 38.

Figure 6A:
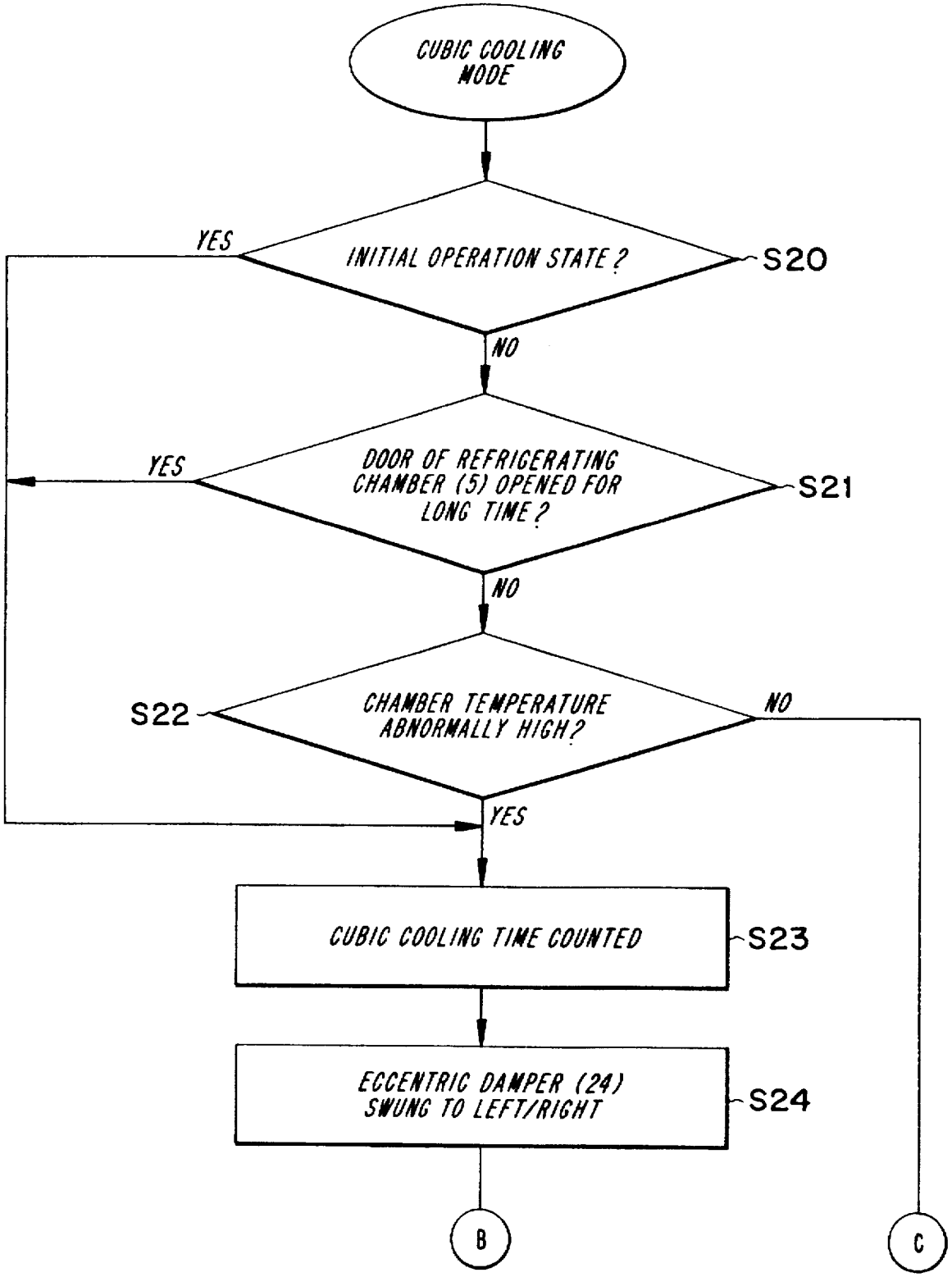
FIGS. 6A and 6B are a flow chart for illustrating an operational sequence of a cubic cooling air supply control in the refrigerator according to the embodiment of the present invention.
Figure 6B:
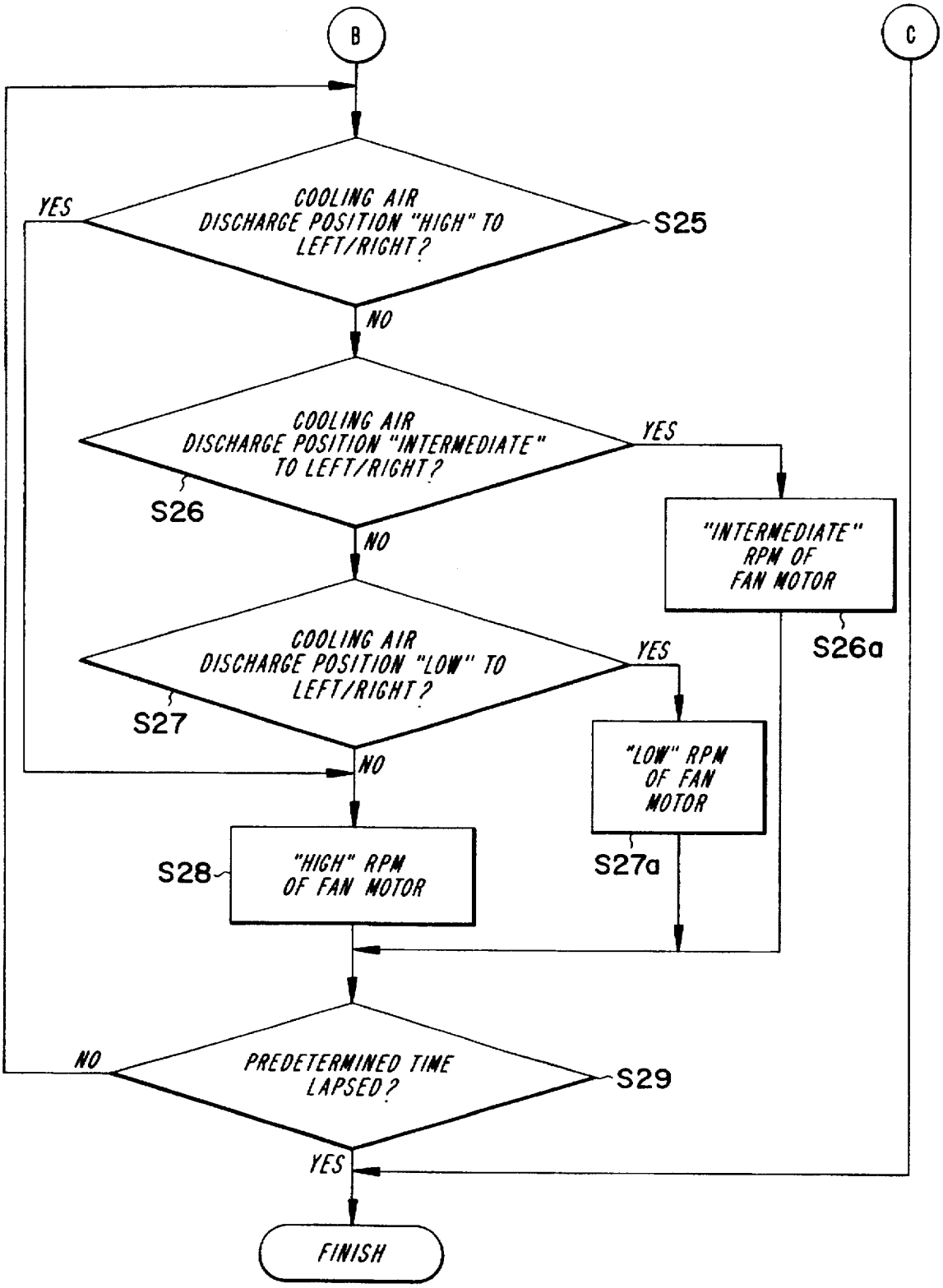

FIG. 6 is a flow chart for illustrating an operational sequence of the cubic cooling air supply control of a refrigerator according to the embodiment of the present invention. Reference symbol S in FIG. 6 denotes a method step.

First of all, in case of the cubic cooling air supply control of the refrigerator, a discrimination is made at step S20 as to whether the refrigerator is under an initial operation state. If the refrigerator is not under the initial operation state (in case of No), flow proceeds to step S21, and discriminates whether or not a door of the refrigerator has been opened for a long time.

As a result of the discrimination at step S21, if the door 10 of the refrigerator 5 has not been opened for a long time (in case of No), the flow advances to step S22, and detects the temperature in the refrigerating chamber 5 by way of the temperature detecting means 40, thereby discriminating whether or not the detected temperature is an abnormal high temperature.

Here, the control means 42 compares the temperature in the chamber detected by the temperature detecting means 40 with a maximum reference temperature and according to the comparison thereof, an abnormal high temperature in the chamber can be discriminated.

As a result of the discrimination at step S22, if the temperature of the refrigerating chamber 5 discriminated by the control means is not an abnormal high temperature (in case of No), there is then no need to quickly cool the whole inner area of the chamber, so that the cubic cooling mode is now completed.

If the temperature in the chamber is the abnormal high temperature (in case of Yes), there is a need to quickly cool the whole inner area of the chamber, so at step S23, a timer inherently stored in the control means 42 starts to count the cubic cooling time.

Meanwhile, as a result of the discrimination at step S20, if the refrigerator is under the initial operation state (in case of Yes), and as a result of discrimination at step S21, if the door 10 of the refrigerating chamber 5 has been opened for a long time (in case of Yes), there is a need to quickly cool the whole inner area of the chamber, so flow proceeds to step S23 and starts to count the cubic cooling time.

Figure 9A:
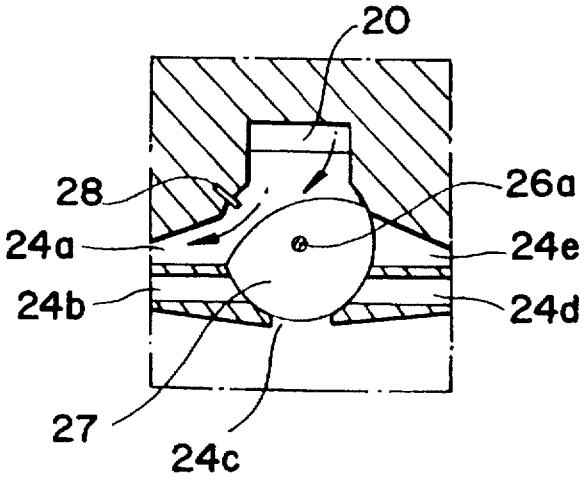
FIGS. 9A–9I illustrate various adjusted positions of an eccentric damper in a cooling air supply control of the refrigerator according to the embodiment of the present invention.
Figure 9B:
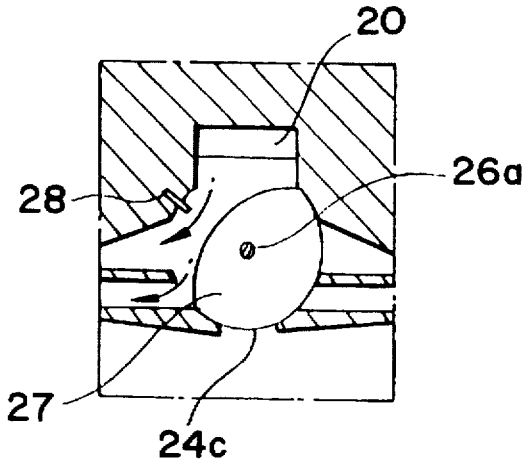
Figure 9C:
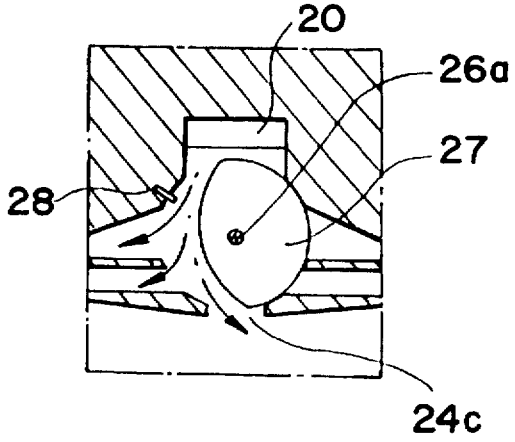
Figure 9D:
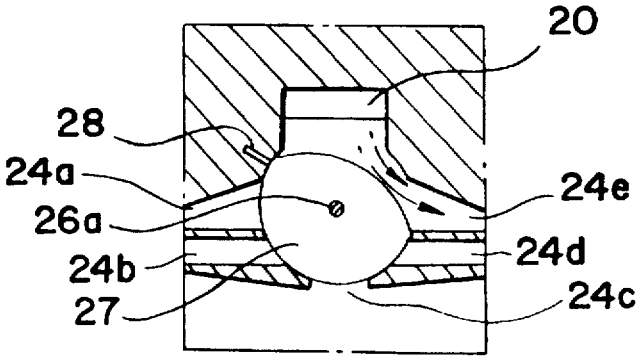
Figure 9E:
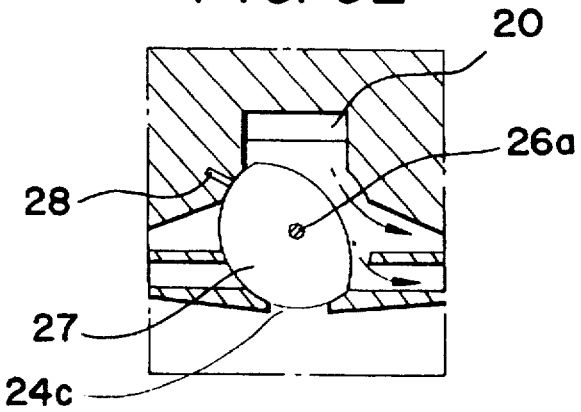
Figure 9F:
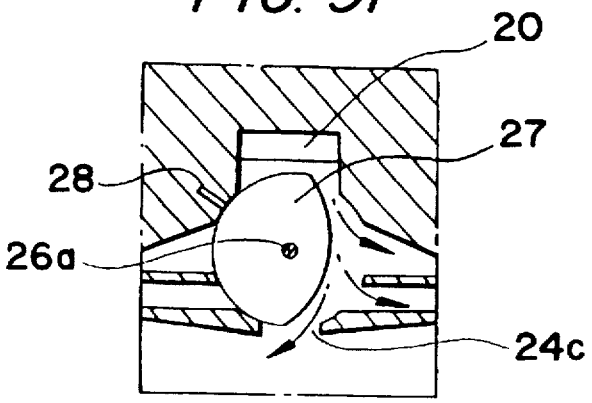
Figure 9G:
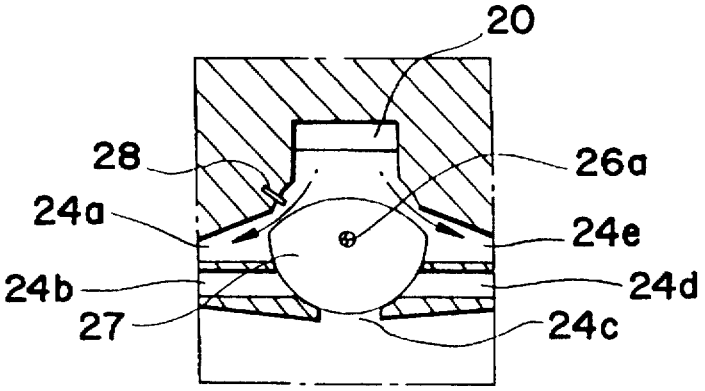
Figure 9H:
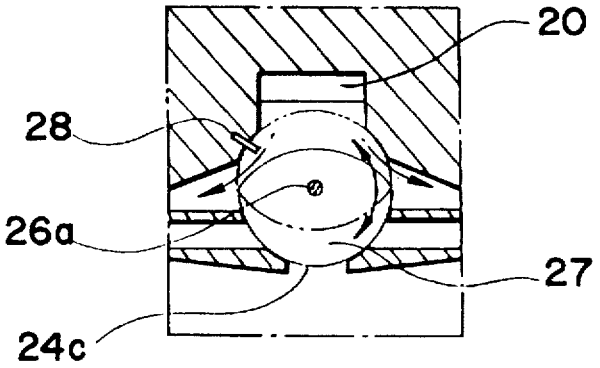

At step S24, a control signal generated from the control means 42 is received by the stepping motor driving means 46 to thereby drive the stepping motor 26, so that the eccentric damper 27 is oscillated to the left and to the right, as illustrated in FIG. 9H.

At step S25, a discrimination is made as to whether or not the eccentric damper 27 is in a position to discharge the cooling air at a "high" level to the left or right side through the cooling air discharge outlets (23*a*, 24*a*, 25*a*) or (23*e*, 24*e*, 25*e*) as illustrated in FIG. 9A or 9D after the eccentric damper 27 has been swung to the left and to the right sides.

As a result of the discrimination at step S25, if the answer is No, flow advances to step S26. At step S26, if the eccentric damper 27 is in a position to discharge to the left the cooling air at an "intermediate" level through the cooling air discharge outlets (23*a*, 23*b*) (24*a*, 24*b*) (25*a*, 25*b*) as shown in FIG. 9B, or to the right through the cooling air discharge outlets (23*d*, 23*e*) (24*d*, 24*e*) (25*d*, 25*e*) as shown in FIG. 9E (in case of Yes), the cooling air can be discharged to the left side or right side of the refrigerating chamber 5 at the "intermediate" level. The flow now proceeds to step S26*a* where the fan motor driving means 44 receives a control signal generated from the control means 42 and drives the fan motor 14 with a revolution per minute (RPM) of the fan motor 14 at an "intermediate" level to thereby drive the fan 14*a*.

Meanwhile, as a result of the discrimination at step S26, if the answer is No, the flow advances to step S27 and discriminates whether or not the eccentric damper 27 is in a position to discharge the cooling air at a "low" level to the left side through the cooling air discharge outlets (23*a*, 23*b*, 23*c*) (24*a*, 24*b*, 24*c*) (25*a*, 25*b*, 25*c*) as shown in FIG. 9C, or to the right side through the cooling air discharge outlets (23*c*, 23*d*, 23*e*) (24*c*, 24*d*, 24*e*) (25*c*, 25*d*, 25*e*) as shown in FIG. 9F.

As a result of the discrimination at step S27, if the answer is Yes, then the cooling air can be discharged at the "low" level to the left or right side of the refrigerating chamber 5.

The flow now proceeds to step S27*a* where the fan motor driving means 44 receives a control signal of the control means 42 to thereby drive the fan motor 14 with the RPM of the fan motor at a "low" level.

Meanwhile, as a result of the discrimination at step S27, if the answer is No, then the damper must be positioned to discharge cooling air at the "high" level to the left side or right side of the refrigerating chamber 5. The flow proceeds to step S28 and at step S28, the fan driving motor 44 receives a control signal of the control means 40 to thereby drive the fan motor 14 with the RPM of the fan motor 14 at a "high" level.

As a result of the discrimination at step S25, if the eccentric damper 27 is in a position to discharge the cooling air at the "high" level to the left through the discharge outlets (23*a*, 24*a*, 25*a*) as shown in FIG. 9A, or to the right through the discharge outlets (23*e*, 24*e*, 25*e*) as shown in FIG. 9D (in case of Yes), then the cooling air can be discharged to the left or right side of the refrigerating chamber 5 at the "high" level.

The flow now proceeds to step S28, and at step S28, the fan motor 14 is driven with the RPM thereof at a "high" level, to thereby cause the fan 14*a* to rotate rapidly.

In other words, the RPM of the fan motor 14 is established at the "high", "intermediate", or "low" level according to the position of the eccentric damper 27.

At step S29, a discrimination is made as to whether the time counted by the timer at step S23 has passed a previously established predetermined time, and if the counted time has not passed the predetermined present time period (in case of No), the flow returns to step S25 and repeats operations subsequent to step 25.

Meanwhile, as a result of the discrimination at step S29, if the counted time has passed the predetermined present time period (in case of Yes), the cubic cooling mode is finished.

Concentrated Cooling Mode

A detailed description about a case where a concentrated cooling operation is selected by the key operation means 38 will be described with reference to FIG. 7.

Figure 7:
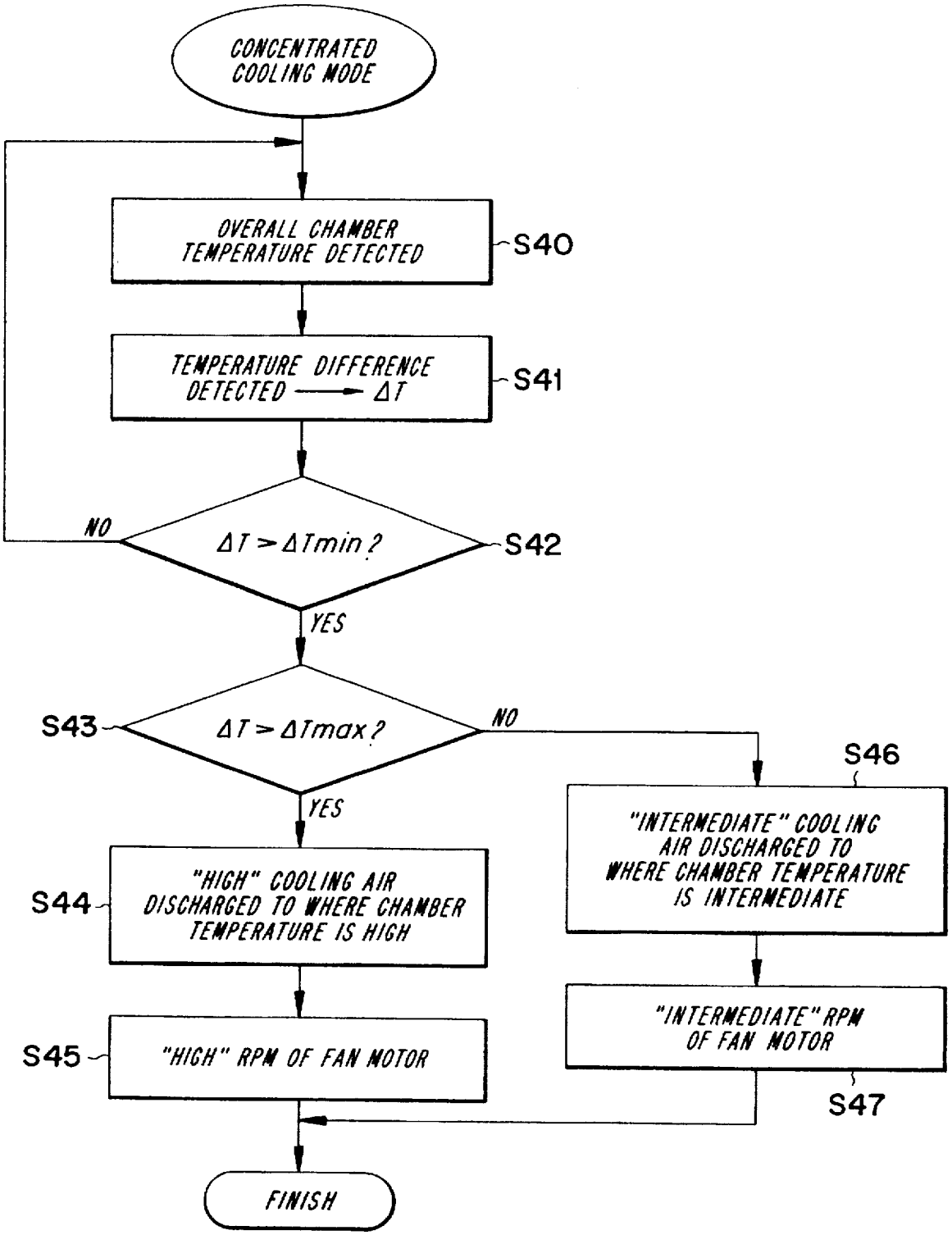
FIG. 7 is a flow chart for illustrating an operational sequence of a concentrated cooling air supply control in the refrigerator according to the embodiment of the present invention.

FIG. 7 is a flow chart for illustrating operating sequence of a concentrated cooling air supply control of a refrigerator according to the embodiment of the present invention and reference symbol S therein denotes a method step.

First of all, at step S40, temperatures T of respective portions in the refrigerating chamber 5 are detected by the temperature detecting means 40 comprising thermistors 31, 32, 33 and 34 respectively arranged at a lower left side, a lower right side, an upper left side and an upper right side of the refrigerating chamber 5, and the temperature data thus detected are output to the control means 42.

Subsequently, at step S41, the temperature data of the portions of the chamber detected by the thermistors 31, 32, 33 and 34 are compared at the control means 42, to thereby calculate a temperature difference ΔT in the refrigerating chamber 5.

Flow now advances to step S42, and a discrimination is made as to whether the temperature difference ΔT in the chamber calculated therefrom is larger than a minimum temperature difference ΔTmin (in other words, the temperature difference required for driving the fan motor) previously established at the control means 42.

As a result of the discrimination at step S42, if the temperature difference in the chamber ΔT is not larger than the minimum temperature difference ΔTmin (in case of No), the flow returns to step S40, and operations subsequent to step S40 are repeatedly carried out.

Meanwhile, as a result of the discriminations at step S42, if the temperature difference ΔT is larger than the minimum temperature difference ΔTmin (in case of Yes), flow proceeds to step S43, and discriminates whether or not the temperature difference ΔT is larger than a maximum temperature difference Tmax (in other words, the temperature difference required for driving the fan motor at a "high" level) previously established at the control means 42.

As a result of the discrimination at step S43, if the temperature difference ΔT is larger than the maximum temperature difference Tmax (in case of Yes), flow advances to step S44 to thereby cause the control means 42 to output a control signal to the stepping motor driving means 46, so that the cooling air heat-exchanged by the evaporator 12 and guided by the duct 20 can be "intensively" discharged through the discharge outlets (23*a*, 24*a*, 25*a*) or through the discharge outlets (23*e*, 24*e*, 25*e*) to a direction where the temperature in the chamber is high, e.g., it is high because the temperature at a particular area in the chamber has risen due to the hot food having been inserted in the particular area in the refrigerating chamber 5.

Accordingly, the stepping motor driving means 4G receives the control signal output from the control means 42 to drive the stepping motor 26 and to thereafter drive and position the eccentric damper 27, so that the cooling air can be discharged at a "high" level toward the area where the temperature is high through the cooling air discharge outlets (23*a*, 24*a*, 25*a*) or discharge outlets (23*e*, 24*e*, 25*e*).

Then, at step S45, the fan motor driving means 44 receives the control signal output from the control means 42 to thereby drive the fan motor 14 at a "high" level. The temperature in the chamber is caused to go down until the temperature difference ΔT in the chamber is no longer larger than the minimum temperature difference ΔTmin. The concentrated cooling mode is then terminated.

Meanwhile, as a result of the discrimination at step S43, if the temperature difference ΔT in the chamber is not larger than the maximum temperature difference ΔTmax (in case of No), flow proceeds to step S46, to thereby cause the control means 42 to output the control signal to the stepping motor driving means 46 so that the cooling air heat-exchanged by the evaporator 12 and guided by the duct 20 can be discharged to the area where the temperature is high through the cooling air discharge outlets (23*a*, 23*b*) (24*a*, 24*b*) (25*a*, 25*b*) or through the outlets (23*d*, 23*e*) (24*d*, 24*e*) (25*d*, 25*e*).

Consequently, the stepping motor driving means 46 receives the control signal output from the control means 42 to thereby drive the stepping motor 26, so that the eccentric damper 27 can be rotated, as illustrated in FIG. 9B or FIG. 9E, in order to cause the cooling air to be discharged to the area where the temperature is high through the cooling air discharge outlets (23*a*, 23*b*) (24*a*, 24*b*) (25*a*, 25*b*) or through discharge outlets (23*d*, 23*e*) (24*d*, 24*e*) (25*d*, 25*e*).

At step S47 the fan motor driving means 44 receives the control signal of the control means 42 to drive the fan motor 14 at an "intermediate" level, and the temperature in the chamber is lowered until the temperature difference in the chamber ΔT is no longer larger than the minimum temperature difference ΔTmin. The concentrated cooling mode is then terminated.

Automatic Swing Mode

Next, a case where the automatic swing operation mode is selected according to the key operation means 38 will be described in detail with reference to FIG. 8.

Figure 8:
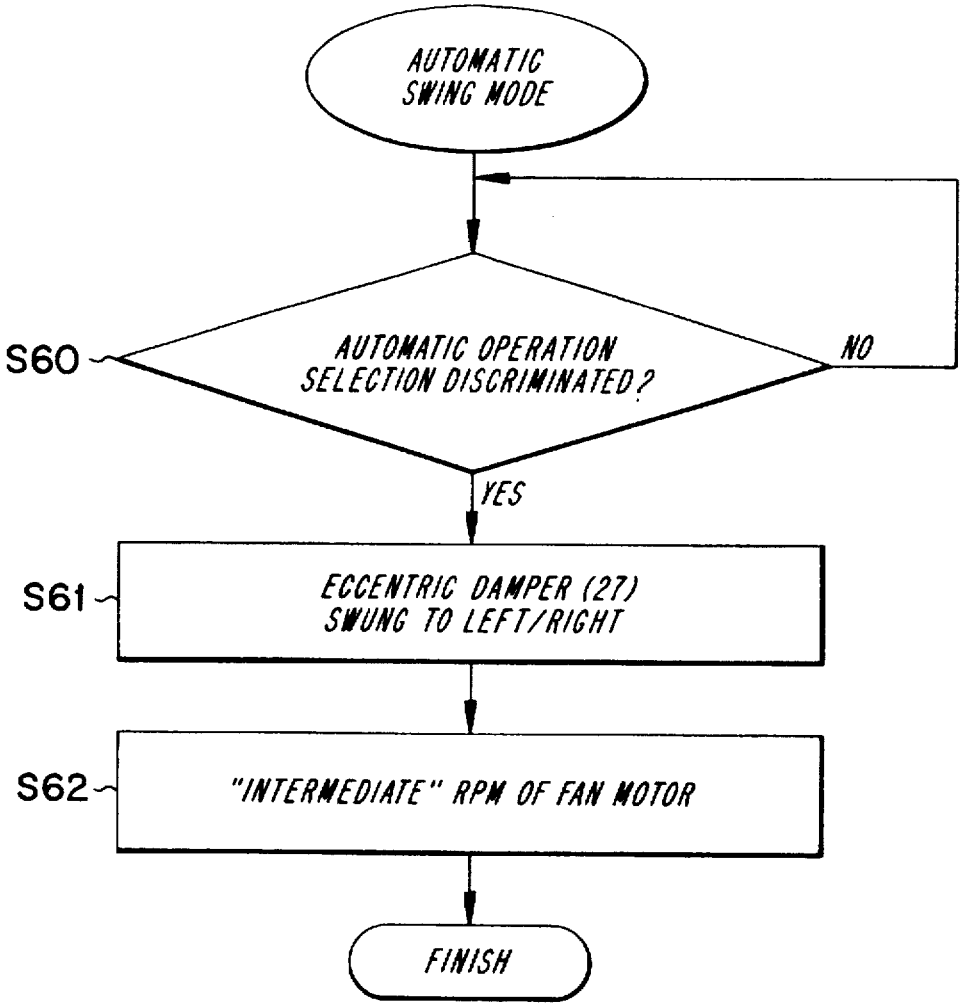
FIG. 8 is a flow chart for illustrating an operational sequence of an automatic swing control in the refrigerator according to the embodiment of the present invention.

FIG. 8 is a flow chart for illustrating an automatic swing control operation procedure of a refrigerator according to the embodiment of the present invention.

First of all, at step S60, it is determined whether an automatic swing mode has been selected by the user. At step S61 the stepping motor 26 receives a signal from the control means to oscillate the eccentric damper to the right and left. Also, at step S62 the fan motor driving means 44 receives the control signal of the control means 42 to drive the fan motor 14 at an "intermediate " level.

The automatic swing operation is then terminated.

When the automatic swing operation is completed, the control signal output from the control means is not generated to the stepping motor driving means 46.

Figure 9I:
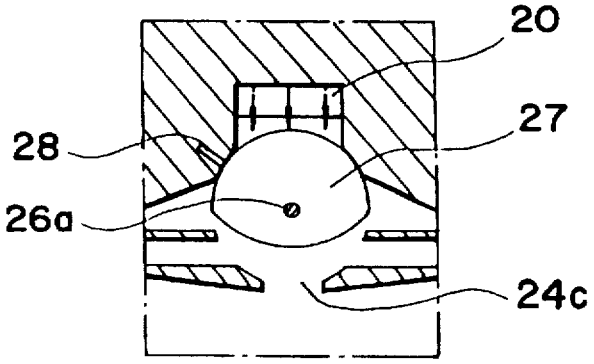

At this time, because the stepping motor 26 is in a state of stoppage, the eccentric damper 27 is placed at a position illustrated in FIG. 9I.

What is claimed is:

1. A refrigerator comprising:

a refrigerating chamber having a rear wall;

a duct disposed at the rear wall for guiding a flow of cold air, the duct including at least one group of horizontally spaced cold air inlet openings for discharging cold air into respective horizontally adjacent areas of the refrigerating chamber;

temperature sensors for detecting temperatures in different regions of the refrigerating chamber;

a motor-driven fan for circulating cold air through the duct and the air inlet openings and into the refrigerating chamber;

a damper arranged adjacent the group of cold air inlet openings and being rotatable about an axis, the damper arranged eccentrically relative to the axis for controlling cold air flows through the cold air inlet openings relative to one another depending on a rotary position of the damper;

a stepping motor connected to the damper for rotating the damper about the axis;

a switch for determining a rotational position of the damper; and a control mechanism connected to the temperature sensors and the stepping motor for comparing sensed temperatures with a reference temperature and rotating the damper for directing cold air into the refrigerating chamber to eliminate temperature differences between the reference temperature and the sensed temperatures.

2. The refrigerator according to claim 1 wherein the damper is arranged to control a quantity of cold air flowing through the cold air inlet openings.

3. The refrigerator according to claim 1 wherein the cold air inlet openings are arranged to surround the damper, the damper arranged to open and close selected ones of the cold air inlet openings.

4. The refrigerator according to claim 1 wherein the temperature sensors are spaced apart vertically and horizontally within the refrigerating chamber.

5. The refrigerator according to claim 1 wherein the damper is rotatable about a vertical axis.

6. The refrigerator according to claim 1 wherein the duct extends vertically, the at least one group of horizontally spaced cold air inlet openings comprises at least two of said groups, said at least two groups spaced apart vertically; there being one said damper for said at least two groups; said damper mounted to the stepping motor for being rotated thereby about a vertical axis.

7. A refrigerator, comprising:

a refrigerating chamber having a rear wall;

a duct disposed at the rear wall for guiding a flow of cold air, the duct including at least one group of horizontally spaced cold air inlet openings for discharging cold air into respective horizontally adjacent areas of the refrigerating chamber;

temperature sensors for detecting temperatures in different regions of the refrigerating chamber;

a motor-driven fan for circulating cold air through the duct and the cold air inlet openings and into the refrigerating chamber;

a damper arranged adjacent the group of cold air inlet openings and being rotatable about an axis, said damper arranged eccentrically relative to the axis for adjusting cold air flows through the cold air inlet openings relative to one another depending on a rotary position of the damper;

a stepping motor connected to the damper for rotating the damper about the axis;

a switch for determining a rotational position of the damper; and a control mechanism connected to the temperature sensors and the stepping motor for comparing sensed temperatures with a reference temperature and rotating the damper for establishing a quantity of cold air through the air inlet openings in accordance with the magnitude of a difference between sensed temperatures and the reference temperature.

8. The refrigerator according to claim 7 wherein the damper is rotatable about a vertical axis.

9. A refrigerator comprising:

a body forming a refrigerating chamber having a rear wall, a duct disposed in the rear wall for receiving a cold air flow, and a plurality of vertically spaced groups of cold air inlet openings communicating with the duct for directing cold air into the refrigerating chamber in respective directions the cold air inlet openings of each of the groups being horizontally spaced apart for directing cold air into horizontally adjacent areas of the refrigerating chamber;

a cold air generator for supplying cold air to the duct; and a motor-driven damper disposed in the duct with respective portions of the damper adjacent each of the groups of cold air inlet openings and positionable in different positions for directing cold air to selected ones of the cold air inlet openings within the groups.

10. The refrigerator according to claim 9 wherein the damper is rotatable about a vertical axis.

* * * * *